United States Patent [19]

Wilson

[11] Patent Number: 4,685,566

[45] Date of Patent: Aug. 11, 1987

[54] SLEEVE-TYPE CARRIER

[75] Inventor: Jerry F. Wilson, West Monroe, La.

[73] Assignee: Manville Sales Corporation, Denver, Colo.

[21] Appl. No.: 813,340

[22] Filed: Dec. 24, 1985

[51] Int. Cl.[4] ..... B65D 71/00

[52] U.S. Cl. ..... 206/429; 206/427; 229/DIG. 9

[58] Field of Search ..... 206/427, 429, 434; 229/DIG. 9

[56] References Cited

U.S. PATENT DOCUMENTS

| | | | |
|---|---|---|---|
| 2,718,301 | 9/1955 | Palmer | 206/427 |
| 2,795,365 | 6/1957 | Currie | 229/DIG. 9 |
| 2,962,202 | 11/1960 | Hansen | 229/DIG. 9 |
| 3,202,339 | 8/1965 | Franklin, Jr. | 229/DIG. 9 |
| 3,812,958 | 5/1974 | Samsing | 206/427 |
| 3,933,303 | 1/1976 | Kirby, Jr. | 206/427 |
| 4,155,449 | 5/1979 | Bryne | 206/427 |
| 4,184,626 | 1/1980 | Graser et al. | 206/427 |
| 4,331,289 | 5/1982 | Killy | 206/427 |
| 4,491,223 | 1/1985 | Oliff | 206/427 |
| 4,545,485 | 10/1985 | Oliff | 206/427 |
| 4,558,816 | 12/1985 | Wood | 206/427 |

*Primary Examiner*—Joseph Man-Fu Moy

*Attorney, Agent, or Firm*—John D. Lister; Cornelius P. Quinn; Timothy R. Schulte

[57] ABSTRACT

A sleeve-type beverage can carrier having end dust flaps which mechanically interlock by means of locking tabs and cutouts. The flap containing the cutouts overlaps the flap containing the locking tabs so that the cutouts and tabs are aligned. The locking tab is folded back to allow the flap with the cutouts to be moved into place, then is inserted through the cutout and also through the portion of the bottom flap from which the locking tab was struck. This provides a secure mechanical lock. In addition, the blank from which the carrier is formed is designed so that the space between dust flaps is identical in shape to that of the dust flaps. This allows multiple widths of blanks to be cut from the sheet stock without scrap loss.

10 Claims, 3 Drawing Figures

SLEEVE-TYPE CARRIER

FIELD OF THE INVENTION

This invention relates to a sleeve-type article carrier, and more particularly to an improved sleeve-type article carrier having dust flaps closing off a major portion of the end openings.

BACKGROUND OF THE INVENTION

A common type of article carrier often used to package twelve beverage cans is the sleeve-type carrier. Basically, there are two different kinds of sleeve-type carriers. One of them completely encloses the cans and is formed from a generally rectangular production blank which is folded and glued by the blank manufacturer to form the top, bottom and side panels. It is shipped in collapsed form to the bottler who opens the semi-formed blank into its sleeve shape, inserts the cans and glues together flaps foldably connected to the blank to form the end panels. Traditionally, some parts of the beverage industry prefer this style of sleeve-type carrier.

The other kind of sleeve-type carrier, which others in the beverage industry prefer, employs end panels which are formed from mechanically interlocked flaps rather than adhesively connected flaps. The flap locking means has tended toward relatively massive locking tabs and related cutouts to hold the end panel flaps securely in place against the stresses caused by shifting cans and rough handling. Very often an additional set of tabs is provided which are designed to interlock with the aperture remaining in the flap from which the main locking tabs were struck. To accommodate these mechanisms and to provide added strength at this area of expected stress, the end panel flaps have overlapped each other a substantial distance. Although these designs have performed adequately, it would be desirable to reduce the cost of the carrier by reducing the extent of the overlap and therefore the amount of paperboard used in producing a carrier blank without impairing the performance of the carrier.

BRIEF SUMMARY OF THE INVENTION

This invention provides a mechanical locking mechanism for the second style of sleeve-type carrier described above which reduces the amount of flap overlap and minimizes the width of the margin or web of material between the locking tabs and the nearest edge of their flap and also between the cutouts and the nearest edge of their flap. This is accomplished by using a locking tab arrangement in which the flap containing the cutout overlaps the flap containing the locking tab, and the locking tab extends through the cutout of the outer flap and through the aperture in the inner flap from which the locking tab was struck. The resulting locking mechanism, the only one employed, does not require a thick web of material at the extremities of the locking tabs or their cutouts and it still permits the flaps to be dimensioned and shaped so that adjacent rows of blanks can be cut from a sheet of stock without significant scrap loss, as has been done in the past in the manufacture of this style of sleeve-type carrier blank.

Other features and aspects of the invention will be made clear, as well as the various benefits of the invention, in the more detailed description of the invention which follows.

DESCRIPTION OF THE INVENTION

Figure 1:
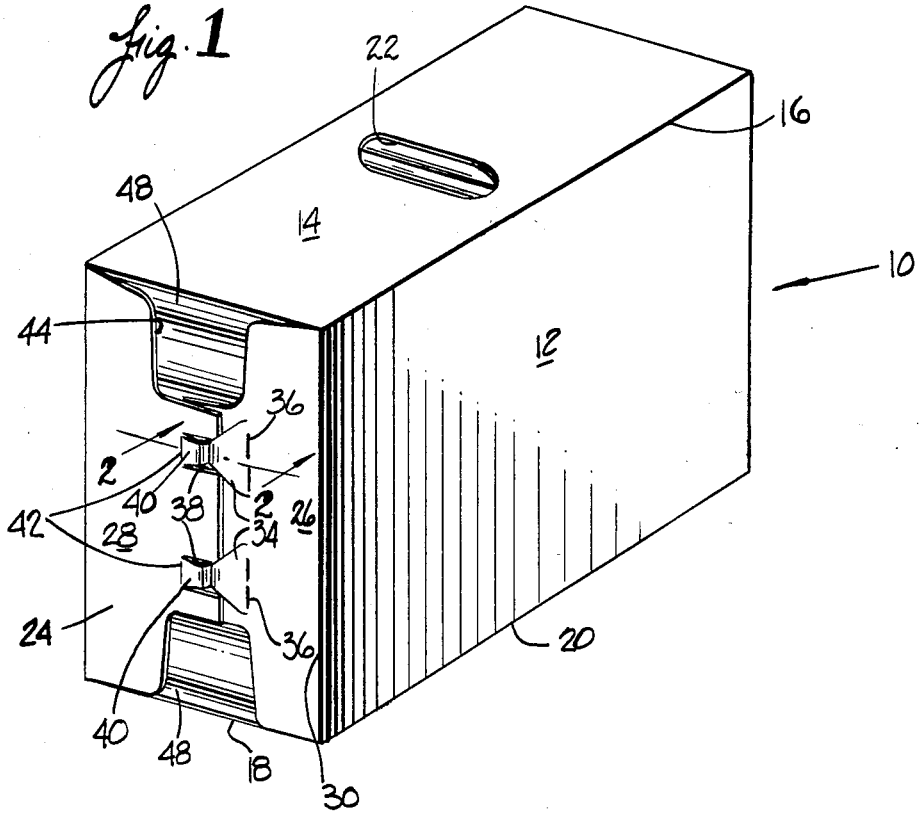
FIG. 1 is a pictorial representation of the sleeve-type carrier of the present invention.

Referring to FIG. 1, sleeve-type carrier 10 comprises side panels 12 connected to top panel 14 by folds 16 and to bottom panel 18 by folds 20. A handle opening 22 extending transversely of the length of the carrier is shown in the top panel 14. This enables the person carrying the package to lift it by inserting his or her fingers into the opening. The particular type of handle employed is of no significance to this invention and could take any other functional form desired. For example, the so-called suitcase type handle could be used, wherein two spaced oblong openings in the top panel extend parallel to the length of the carrier, for receiving the thumb and fingers of the user.

The end panels 24 are comprised of flaps 26 and 28 foldably connected to the side panels 12 at 30 and 32, respectively. Locking tabs 34, attached to flap 26 by folds 36, are shown extending into cutouts 38 and being engaged by retaining tabs 40 which may be foldably connected to flap 28 at 42. As can be seen, the flaps 26 and 28 are similarly shaped and form gaps 44 and 46 between the end panels 24 and the top and bottom panels 14 and 18. Although the beverage cans 48 are visible at the gaps, they are solidly restrained by the end panels and are in no danger of breaking free. The purpose of this arrangement will be made clear in connection with the description of the production blank.

Figure 3:
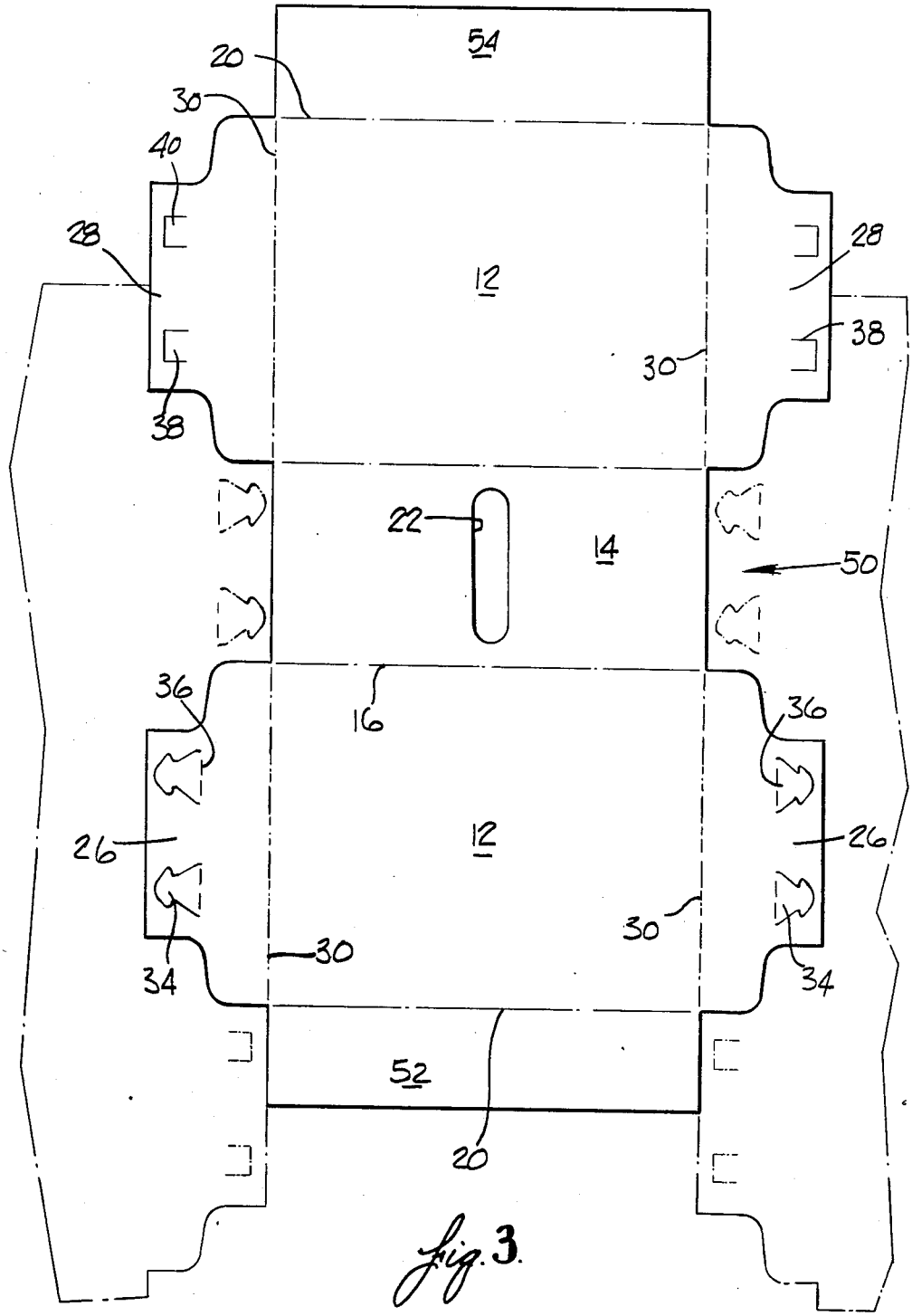
FIG. 3 is a plan view of a production blank for forming the carrier of the present invention.

Referring to FIG. 3, production blank 50 is comprised of rectangular central section 14, corresponding to upper panel 14 of the carrier shown in FIG. 1, rectangular intermediate sections 12, corresponding to side panels 12 of the carrier, and rectangular end sections 52, which when glued together form lower panel 18 of the carrier. Intermediate sections 12 are connected to the central and end sections by score lines 16 and 20, respectively, which correspond to the folds 16 and 20 of the carrier of FIG. 1. As mentioned above, the handle opening 22, shown in the central section 14, need not take this particular form but could be any desired handle arrangement such as the well known suitcase type of handle described above. In that design each of the end sections of the blank usually receives one of the handle openings so that when the end sections are adhered to each other the resulting panel is the top panel. In such an arrangement the central section of the blank then becomes the bottom panel of the carrier. It should be understood that either arrangement can be used in the carrier and blank of the present invention.

Still referring to FIG. 3, dust flaps or end flaps 26, corresponding to the end flaps 26 of FIG. 1, are connected b score lines 30 to the opposite edges of one of the intermediate sections 12. Similarly, end flaps 28 are connected by score lines 30 to the opposite edges of the other intermediate section 12. The end flaps 26 carry locking tabs 34 which, upon the blank being folded at the score lines to form the carrier of FIG. 1, are received by cutouts 38 in the end flaps 28. The tabs 34, shown as having an arrowhead configuration which provides shoulders 56, are connected to the end flaps 26 by score lines 36 to facilitate their insertion into the cutouts. The retaining tabs 40, which are struck on three sides to create the cutouts 38, may be connected to the end flaps 28 by fold lines to facilitate bending back as the locking tabs are inserted into the cutouts. Alternatively, if the width of the retaining tabs is relatively narrow, no fold line need be provided, the low resistance to bending by the narrow retaining tab being enough to permit it to bend back sufficienty easily.

It can be seen that both the locking tabs and the cutouts are positioned close to the end margins of the flaps 26 and 28. By keeping the tabs and cutouts close to the end margins, but still allowing enough thickness of stock to prevent tearing, the distance the flaps extend from the side panels of the carrier can be minimized, thereby reducing the overall width of the production blank and as a result reducing the cost of the stock from which the carrier is made. Further, by making the locking tabs and cutouts as short as practicable, that is, by minimizing the distance they extend in the direction of their length,the amount of overlap required by the attachment of flap 26 to flap 28 is minimized. This too contributes to the ability to make the end flaps as short as possible without adversely affecting the ability of the carrier to securely hold beverage cans without tearing.

The reason why the narrowing of the blank, even by a relatively small amount is such an important cost reduction measure is because such narrowing results in a like amount of savings of stock. This is because there is virutally no scrap produced between the rows of blanks in the blank cutting operation. As can be seen in FIG. 3, the shape of the space bounded by the central section 14, the opposing margins of the proximate flaps 26 and 28, and a line connecting the outermost margins of the flaps is identical in size and shape to the flaps themselves. Thus, as shown by the phantom lines, the flap of an identical blank would occupy this space as the blanks are cut from sheet stock, enabling multiple rows of blanks to be produced without interior scrap loss. This makes the width of the top panel of the carrier equal to the height of the flaps at their outermost extremities. While this type of relationship is known in the art, it is important that the locking mechanism of the present invention not interfere with this arrangement. It is clear from the description and drawings that the shortening of the flaps, and thus the narrowing of the blank does not prevent this arrangement.

Figure 2:
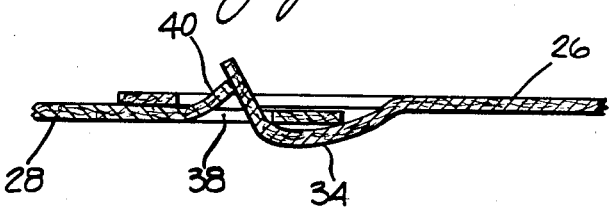
FIG. 2 is a partial sectional view taken on line 2—2 of FIG. 1, further illustrating the locking mechanism of the carrier of the present invention.

Referring to FIG. 2, it can be seen that the end portion of the flap 28, which contains the cutout 38, overlaps the end portion of the flap 26 so that the arrowhead portion of the locking tab 34 overlies the cutout. The tab 34 will have been bent back about its fold line to permit the flap 28 to directly overlie the flap 26. The tab is then inserted into the cutout, pushing back retaining tab 40 in the process, and extending through the opening in the flap 26 produced as a result of the locking tab 34 having been struck from the flap 26 during creation of the locking tab in the die cutting operation. It is understood that the widest part of the arrowhead formation of the locking tab is slightly wider than the width of the cutout so that after having been forced or squeezed through the cutout, the shoulders 56 of the locking tab will assist in preventing the locking tab from being pulled out of the cutout.

In practice, the cutouts and the locking tabs can be quite small and still provide sufficient holding power to keep the end flaps from disengaging. Also, the width of the web of material between the ends of the locking tabs and cutouts and the outer edge of the flaps can be quite small and still not tear during handling. For example, in one working embodiment the locking tabs and cutouts were only $\frac{1}{4}$ inch from the outer edge of the flaps. The cutouts were $\frac{5}{8}$ inch square and the locking tabs were approximately one inch long.

By this arrangement the overlapping end flap is securely held tight against the other end flap by the locking tabs in a very simple yet highly effective and economical design. Complicated locking arrangements to effect this result are avoided, and without the need for long end flaps or wide webs between the tabs or cutouts and the outer edges of the flaps the resulting shorter end flaps allow the economies discussed previously. Further, no other type of locking mechanism other than the mechanism described herein is needed to accomplish the task of holding the flaps securely in place.

It should be understood that the specific shape of the end flaps can be other than that shown, as long as the relationship between the width of the top panel and the height of the outermost edge of the end flaps is maintained to enable adjacent rows of blanks to be cut from sheet stock with no scrap produced between common blank edges.

It should further be obvious that although a preferred embodiment of the invention has been described, it is possible to make changes to certain specific details without departing from the spirit and scope of the invention.

What is claimed is:

1. A sleeve-type carrier, comprising:

a top panel, a bottom panel, side panels integral with and foldably connected to the top and bottom panels, and end panels closing a major portion of the end openings between the top, bottom and side panels, each end panel comprising two mechanically interlocked flaps integral with and foldably connected to the adjacent ends of the side panels, each flap being of generally similar shape and extending from its side panel a distance greater than half the width of the carrier, whereby the end portion of one flap overlaps the end portion of the other flap, said one flap containing a cutout in the overlapping area of the flap near the outer edge thereof and the other flap containing a locking tab struck therefrom, the end of the portion of said other flap from which the locking tab was struck being near the outer edge of said other flap and the base of the locking tab being foldably connected to said other flap at a location spaced from the outer edge of said one flap, the locking tab extending over the outer edge of said one flap, through the cutout in said one flap and through the portion of the other flap from which the locking tab was struck, thereby mechanically locking the flaps together, the height of the flaps at the foldable connections to the side panels being greater than the height of the flaps in their overlapping end portions, whereby the end panels contain open gaps located centrally thereof adjacent the top and bottom panels, and wherein the cutout contains a retaining tab struck from said one flap, whereby the retaining tab assists in holding the locking tab in place.

2. A carrier according to claim 1, wherein each said one flap contains two cutouts and each of the other flaps contains two locking tabs.

3. A carrier according to claim 1, wherein the height of the flaps at their outer edge is equal to the width of the top panel.

4. A carrier according to claim 1, wherein the locking tab contains shoulders abutting said one flap adjacent the cutout to resist being pulled out of the cutout.

5. A carrier according to claim 4, wherein the locking tab and cutout interlock is the only type of locking mechanism holding the flaps together.

6. A production blank adapted to be formed into a sleeve-type article carrier, comprising:

sheet material having a generally rectangular central section, generally rectangular end sections and generally rectangular intermediate sections connected to the central and end sections by score lines, the intermediate sections intended to become the side panels of the carrier, flap sections connected to the intermediate sections by score lines, the flap sections intended to become the end panels of the carrier, the flap sections extending from the intermediate sections a distance greater than half the width of the central section whereby upon folding the blank to form a carrier, the end portions of the flap sections connected to one of the intermediate sections will overlap the end portion of the flap sections connected to the other intermediate section to form the end panels of the carrier, the flap sections connected to said one intermediate section containing a cutout near the outer ends of the flap sections, and the flap sections connected to said other intermediate section containing a locking tab struck from the flap sections, the end of the portions of the flap sections from which the locking tab was struck being near the outer ends of the flap sections and the locking tabs being foldably connected at their bases to the flap sections, the locking tab being adapted, when the blank is formed into a carrier, to extend over the outer edge of the flap section containing the cutout, through the cutout and through the portion of the flap section from which the locking tab was struck, to mechanically lock the flap sections together.

the cutout containing a retaining tab for assisting to hold the locking tab in place when the blank is formed into a carrier and the locking tab has been inserted into the cutout, the shape and dimensions of the flap sections being such that the space bounded by the end of the central section, the opposing edges of the proximate flap sections and a line connecting the outer edges of the flap sections is identical in size and shape to that of the flap sections.

7. A production blank according to claim 6, wherein the flap sections connected to said one intermediate section contain two cutouts in the overlapping area and the flap sections connected to said other intermediate section contain two locking tabs.

8. A production blank according to claim 6, wherein the locking tab contains shoulder portions adapted to abut the flap section containing the cutout when the blank is formed into a carrier and the locking tab has been inserted into the cutout, whereby stresses tending to pull the locking tab out of the cutout are resisted.

9. A production blank according to claim 8, wherein the locking tab and cutout locking mechanism is the only type of locking mechanism holding together the flaps of a carrier formed from the blank.

10. A production blank according to claim 7, wherein the blank is designed so that a carrier formed from the blank will carry twelve beverage cans, and the cutout is located approximately ¼ inch from the outer edge of the flap containing the cutout.

* * * * *